US008344636B2

(12) United States Patent
Cheng

(10) Patent No.: US 8,344,636 B2
(45) Date of Patent: Jan. 1, 2013

(54) FIXED FREQUENCY DIMMING METHOD AND FIXED FREQUENCY DIMMING CIRCUIT FOR LIGHT EMITTING MODULE

(75) Inventor: Chin-Chung Cheng, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 269 days.

(21) Appl. No.: 12/689,933

(22) Filed: Jan. 19, 2010

(65) Prior Publication Data

US 2011/0012522 A1 Jan. 20, 2011

(30) Foreign Application Priority Data

Jul. 15, 2009 (TW) ..... 98123976 A

(51) Int. Cl.
*H05B 37/02* (2006.01)

(52) U.S. Cl. ..... 315/224; 315/291; 315/307; 315/308

(58) Field of Classification Search ..... 315/209 R, 315/224, 244, 245, 291, 302, 307, 308
See application file for complete search history.

(56) References Cited

U.S. PATENT DOCUMENTS

| | | | | |
|---|---|---|---|---|
| 7,317,302 | B1 * | 1/2008 | Collins | 323/222 |
| 2009/0066264 | A1 * | 3/2009 | Huang et al. | 315/294 |
| 2011/0204802 | A1 * | 8/2011 | Welten | 315/193 |

* cited by examiner

*Primary Examiner* — Jimmy Vu
(74) *Attorney, Agent, or Firm* — Morris Manning & Martin LLP; Tim Tingkang Xia, Esq.

(57) ABSTRACT

A fixed frequency dimming method and fixed frequency dimming circuit for a light emitting module can control light emitting brightness of the light emitting module through a hysteresis control circuit. A voltage difference between an upper limit voltage and a lower limit voltage of a hysteresis width of the hysteresis control circuit is maintained at a fixed value, and a driving current flowing through the light emitting module is changed by changing the upper limit voltage or the lower limit voltage.

6 Claims, 4 Drawing Sheets

FIXED FREQUENCY DIMMING METHOD AND FIXED FREQUENCY DIMMING CIRCUIT FOR LIGHT EMITTING MODULE

CROSS-REFERENCE TO RELATED APPLICATIONS

This non-provisional application claims priority under 35 U.S.C. §119(a) on Patent Application No(s). 098123976 filed in Taiwan, R.O.C. on Jul. 15, 2009, the entire contents of which are hereby incorporated by reference.

BACKGROUND

1. Field of Invention

The present invention relates to a brightness adjusting method, and more particularly to a fixed frequency dimming method and a fixed frequency dimming circuit for a light emitting module.

2. Related Art

In recent years, the manufacturing technology of a light emitting diode (LED), one of semiconductor light emitting components, develops rapidly. In particular, since a blue LED is successfully developed, such that LEDs having three primary colors of light are all available, light of various wavelengths may be realized by combining the LEDs of three primary colors. Therefore, the application scope of the LEDs rapidly expands.

As for operational characteristics, brightness of an LED changes with a current. When a high current flows through a light emitting component, a high-brightness light emitting effect is achieved. On the contrary, if the flowing current is reduced, the brightness of the light emitting component is relatively lowered.

In the prior art, an amplitude of a driving current of an LED can be modulated through hysteresis control, thereby changing the brightness of the LED. In other words, a hysteresis DC/DC converter is used to control a level of the driving current of the LED.

A relation formula of the hysteresis control is as shown in Formula One below.

$$F_s = \frac{(V_{in} - V_{out}) \times D}{Hys_{Amp} \times L \times I_{set}} \qquad \text{Formula One}$$

$F_s$ represents an oscillation frequency, $V_{in}$ represents an input voltage, $V_{out}$ represents an output voltage, D represents an input voltage/output voltage, $I_{set}$ represents an output current (that is, a driving current of an LED), L represents an inductance, and $Hys_{Amp}$ represents a hysteresis oscillation width.

During the process for implementing level modulation of an output current, as the input voltage, the output voltage, the inductance, and the hysteresis oscillation width are all maintained at fixed values, the oscillation frequency of the circuit changes with the level of the output current. In other words, decrease of the output current causes proportional increase of the oscillation frequency.

However, when the oscillation frequency changes with the level of the output current, the protection design of electromagnetic interference (EMI) is relatively difficult. Moreover, conversion loss often exists during the DC/DC conversion. When the oscillation frequency increases, the conversion loss increases, resulting in lower conversion efficiency.

SUMMARY OF THE INVENTION

In view of the above problems, the present invention is a fixed frequency dimming method and a fixed frequency dimming circuit for a light emitting module, which solve a problem that a circuit oscillation frequency changes with an output level in the prior art.

In order to achieve the above objectives, the fixed frequency dimming method for a light emitting module of the present invention is used for controlling light emitting brightness of the light emitting module through a hysteresis control circuit.

Here, the light emitting module and an inductor component are connected in series between a sensing end and a switching end of the hysteresis control circuit, and an impedance component is connected between a voltage input end and the sensing end of the hysteresis control circuit.

Also, a voltage difference between an upper limit voltage and a lower limit voltage of a hysteresis width of the hysteresis control circuit is maintained at a fixed value.

Subsequently, a driving current flowing through the light emitting module is changed by changing the upper limit voltage or the lower limit voltage, thereby adjusting the light emitting brightness of the light emitting module.

The upper limit voltage or the lower limit voltage is changed by a controlled current source. Alternatively, an adjustable upper limit voltage or an adjustable lower limit voltage is provided by a controlled voltage source.

The fixed frequency dimming circuit for a light emitting module of the present invention is used for controlling light emitting brightness of the light emitting module.

The fixed frequency dimming circuit for a light emitting module comprises a hysteresis control circuit, an inductor component, and an impedance component.

The hysteresis control circuit has a voltage input end, a sensing end, a switching end, an upper limit voltage end, and a lower limit voltage end.

The light emitting module and the inductor component are connected in series between the sensing end and the switching end of the hysteresis control circuit.

The impedance component is connected between the voltage input end and the sensing end of the hysteresis control circuit.

A voltage difference between the upper limit voltage end and the lower limit voltage end of the hysteresis control circuit is a fixed value. Here, a variable voltage is provided at the upper limit voltage end or the lower limit voltage end, thereby changing a driving current flowing through the light emitting module, so as to change light emitting brightness of the light emitting module.

Here, the fixed frequency dimming circuit of a light emitting module may further comprise a fixed current source, a controlled current source, a first divider resistor, and a second divider resistor.

In an embodiment, the fixed current source is connected to the upper limit voltage end, and the controlled current source is connected to the lower limit voltage end.

The first divider resistor is connected between the upper limit voltage end and the lower limit voltage end, and the second divider resistor is connected between the lower limit voltage end and a ground.

Here, the fixed current source provides a fixed current to maintain reference voltages at hysteretic high and low levels, that is, to maintain a constant voltage difference between the upper limit voltage end and the lower limit voltage end.

Subsequently, the controlled current source provides a variable voltage at the lower limit voltage end, so as to adjust an output level (that is, a driving current of the light emitting module), thereby changing light emitting brightness of the light emitting module.

Moreover, in another embodiment, the controlled current source is connected to the upper limit voltage end, and the fixed current source is connected to the lower limit voltage end.

The first divider resistor is connected between the upper limit voltage end and the lower limit voltage end, and the second divider resistor is connected between the upper limit voltage end and a fixed voltage source.

Here, the fixed current source provides a fixed current to maintain the reference voltages at hysteretic high and low levels, that is, to maintain a constant voltage difference between the upper limit voltage end and the lower limit voltage end.

Subsequently, the controlled current source provides a variable voltage at the upper limit voltage end, so as to adjust an output level (that is, a driving current of the light emitting module), thereby changing the light emitting brightness of the light emitting module.

In conclusion, in the fixed frequency dimming method and the fixed frequency dimming circuit for a light emitting module according to the present invention, light emitting brightness of the light emitting module is controlled by a hysteresis control circuit. A voltage difference between an upper limit voltage and a lower limit voltage of a hysteresis width of the hysteresis control circuit is maintained at a fixed value, and a driving current flowing through the light emitting module is changed by changing the upper limit voltage or the lower limit voltage. Therefore, the hysteresis oscillation width of the hysteresis control circuit changes linearly with an output level (that is, a level of the driving current), so as to keep a constant oscillation frequency of the hysteresis control circuit. Thus, a single component is used to protect against electromagnetic interference (EMI). Moreover, as the oscillation frequency is kept constant, fixed conversion efficiency can be maintained.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In the present invention, a hysteresis control circuit is used to control light emitting brightness of a light emitting module. A voltage difference between an upper limit voltage and a lower limit voltage of a hysteresis width of the hysteresis control circuit is maintained at a fixed value, and a driving current flowing through the light emitting module is changed by changing the upper limit voltage or the lower limit voltage.

Figure 1:
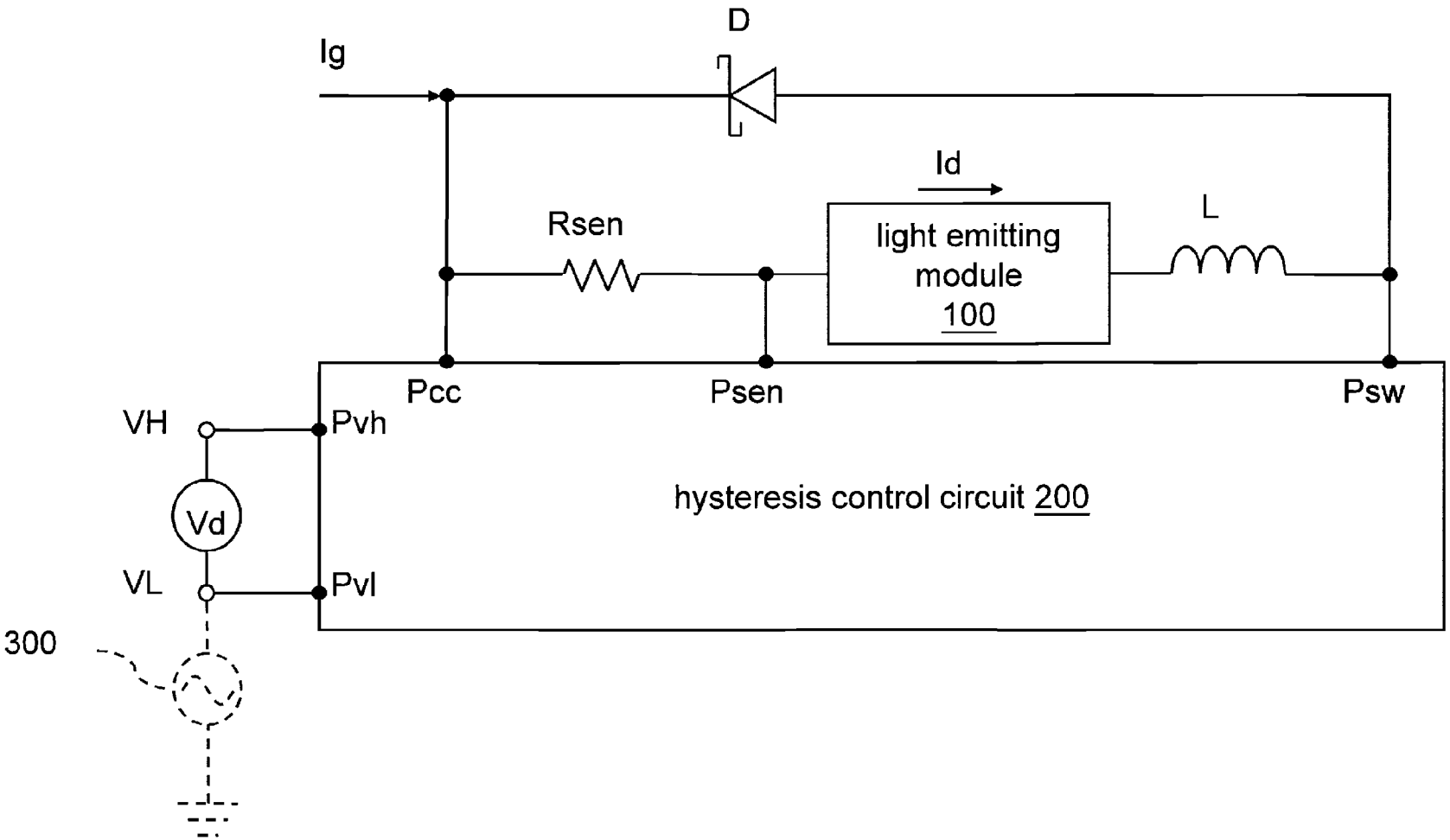
FIG. 1 is a schematic view of a fixed frequency dimming circuit for a light emitting module according to a first embodiment of the present invention.

FIG. 1 shows a fixed frequency dimming circuit for a light emitting module according to an embodiment of the present invention. The "connections" in the embodiments below are electrical connections.

Referring to FIG. 1, the fixed frequency dimming circuit for a light emitting module comprises a hysteresis control circuit 200, an inductor component L, and an impedance component Rsen.

The hysteresis control circuit 200 has a voltage input end Pcc, a sensing end Psen, a switching end Psw, an upper limit voltage end Pvh, and a lower limit voltage end Pvl.

The upper limit voltage end Pvh has an upper limit voltage VH, and the lower limit voltage end Pvl has a lower limit voltage VL.

The light emitting module 100 and the inductor component L are sequentially connected in series between the sensing end Psen and the switching end Psw of the hysteresis control circuit 200. The light emitting module 100 may comprise at least a light-emitting diode (LED) connected between the sensing end Psen and the inductor component L. When the light emitting module 100 has a plurality of LEDs, the LEDs may be connected in parallel and/or in series between the sensing end Psen and the inductor component L.

The impedance component Rsen is connected between the voltage input end Pcc and the sensing end Psen of the hysteresis control circuit 200.

A protection circuit, for example, Schottky diode D, is connected between the voltage input end Pcc and the switching end Psw of the hysteresis control circuit 200.

In other words, the impedance component Rsen, the light emitting module 100, and the inductor component L are sequentially connected in series, and the Schottky diode D is connected in parallel with the impedance component Rsen, the light emitting module 100, and the inductor component L connected in series.

Here, a hysteresis width is provided between the upper limit voltage end Pvh and the lower limit voltage end Pvl of the hysteresis control circuit 200. A voltage difference between the upper limit voltage VH and the lower limit voltage VL of the hysteresis width is maintained at a fixed value. That is, the voltage difference Vd between the upper limit voltage end Pvh and the lower limit voltage end Pvl is a fixed voltage.

Moreover, a variable voltage is provided to the lower limit voltage end Pvl of the hysteresis control circuit 200.

Here, an input current Ig is input from the voltage input end Pcc of the hysteresis control circuit 200. That is, the input current Ig is connected to another end of the impedance component Rsen opposite to an end that the light emitting module 100 is connected. Subsequently, the input current Ig is compared with the upper limit voltage VH and the lower limit voltage VL of the hysteresis width respectively, so as to control current circulation time of the switching end Psw, such that the driving current Id is limited between the upper limit and the lower limit of the hysteresis width.

The driving current Id flowing through the light emitting module 100 may be changed by modulating only the variable voltage provided to the lower limit voltage end Pvl of the hysteresis control circuit 200 (that is, changing the lower limit voltage VL of the lower limit voltage end Pvl). A controlled voltage source 300 may be connected to the lower limit voltage end Pvl of the hysteresis control circuit 200 to provide the variable voltage to the lower limit voltage end Pvl.

Figure 2:
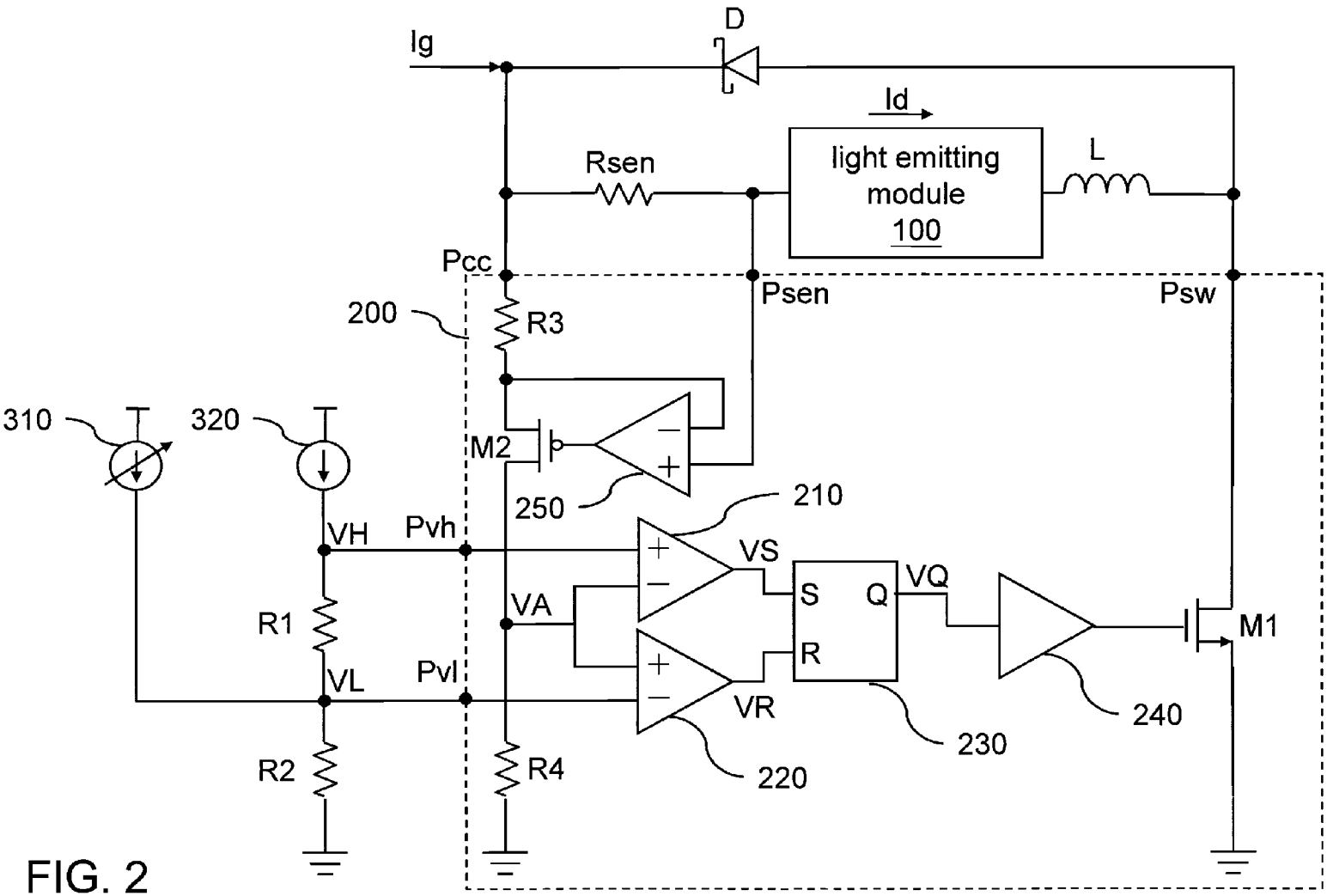
FIG. 2 is a schematic view of a fixed frequency dimming circuit for a light emitting module according to a second embodiment of the present invention.

Referring to FIG. 2, a controlled current source 310 is connected to the lower limit voltage end Pvl to change the lower limit voltage VL.

The fixed current source 320 is connected to the upper limit voltage end Pvh. The first divider resistor R1 is connected between the upper limit voltage end Pvh and the lower limit voltage end Pvl. The second divider resistor R2 is connected between the lower limit voltage end Pvl and a ground.

Here, the fixed current source 320 provides a fixed current to maintain reference voltages at hysteretic high and low levels of the hysteresis control circuit 200, that is, to maintain a constant voltage difference between the upper limit voltage end Pvh and the lower limit voltage end Pvl.

Subsequently, the controlled current source 310 provides a variable voltage (VL) to the lower limit voltage end Pvl, so as to adjust an output level (that is, the driving current Id of the light emitting module 100), thereby changing the light emitting brightness of the light emitting module 100.

The hysteresis control circuit 200 comprises a first comparator 210, a second comparator 220, a flip-flop 230, a driving circuit 240, and a switch component M1.

A positive input end (+) of the first comparator 210 is connected to the upper limit voltage end Pvh, and a negative input end (−) of the first comparator 210 is connected to the voltage input end Pcc through a third divider resistor R3. An output end of the first comparator 210 is connected to a first input end (S) of the flip-flop 230.

A positive input end (+) of the second comparator 220 is connected to a negative input end (−) of the first comparator 210, and is connected to the voltage input end Pcc through the third divider resistor R3. A negative input end (−) of the second comparator 220 is connected to the lower limit voltage end Pvl. An output end of the second comparator 220 is connected to a second input end (R) of the flip-flop 230.

A fourth divider resistor R4 is connected between the negative input end (−) of the first comparator 210 and the ground, and is connected between the positive input end (+) of the second comparator 220 and the ground.

An output end (Q) of the flip-flop 230 is connected to an input end of the driving circuit 240, and the output end of the driving circuit 240 is connected to a control end of the switch component M1.

The switch component M1 is connected between the switching end Psw and the ground.

A switch component M2 may be connected between the third divider resistor R3 and the fourth divider resistor R4, and a control end of the switch component M2 is connected to an output end of an operational amplifier 250. A positive input end (+) of the operational amplifier 250 is connected to a sensing end Psen, and a negative input end (−) of the operational amplifier 250 is connected to a contact between the third divider resistor R3 and the switch component M2.

An input current Ig is input from the voltage input end Pcc, and flows through the third divider resistor R3 and the fourth divider resistor R4 to form an input voltage VA on the negative input end (−) of the first comparator 210 and the positive input end (+) of the second comparator 220.

The first comparator 210 compares the input voltage VA and the upper limit voltage VH to generate a control signal VS. The second comparator 220 compares the input voltage VA and the lower limit voltage VL to generate a control signal VR.

The flip-flop 230 then outputs a control signal VQ according to the two control signals VS and VR, so as to control a turn-on time and a turn-off time of the switch component M1.

During a turn-on time interval of the switch component M1, the driving current Id flowing through the light emitting module 100 linearly increases to an upper limit of the hysteresis width. When the driving current Id increases greater than the upper limit of the hysteresis width, the switch component M1 is switched from a turn-on state to a turn-off state.

During a turn-off time interval of the switch component M1, the driving current Id linearly decreases to a lower limit of the hysteresis width. Also, when the driving current Id decreases lower than the lower limit of the hysteresis width, the switch component M1 is switched from the turn-off state to the turn-on state.

The driving current Id is limited between the upper limit and the lower limit of the hysteresis width through alternate switching between the turn-on state and the turn-off state of the switch component M1.

Here, the fixed current source 320 outputs a fixed current, so as to maintain a constant voltage difference between the upper limit voltage end Pvh and the lower limit voltage end Pvl. Therefore, when an output current of the controlled current source 310 is modulated, the lower limit voltage VL of the lower limit voltage end Pvl is changed, and the upper limit voltage VH of the upper limit voltage end Pvh changes correspondingly based on the constant voltage difference.

Figure 3:
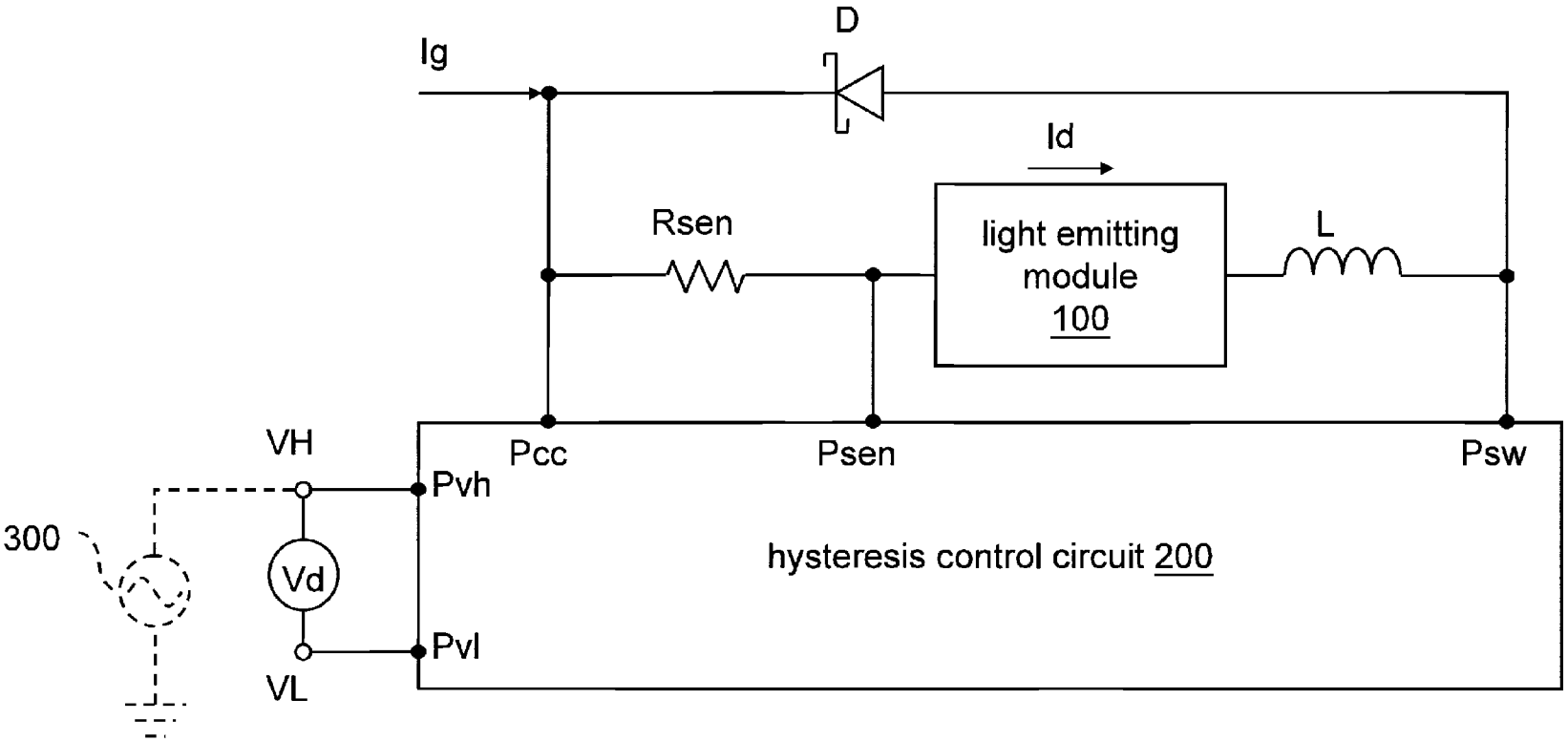
FIG. 3 is a schematic view of a fixed frequency dimming circuit for a light emitting module according to a third embodiment of the present invention.

In addition, referring to FIG. 3, the driving current Id flowing through the light emitting module 100 may also be changed by modulating a variable voltage provided to the upper limit voltage end Pvh of the hysteresis control circuit 200 (that is, changing the upper limit voltage VH of the upper limit voltage end Pvh).

A controlled voltage source 300 may be connected to the upper limit voltage end Pvh of the hysteresis control circuit 200, so as to provide the variable voltage to the upper limit voltage end Pvh.

Figure 4:
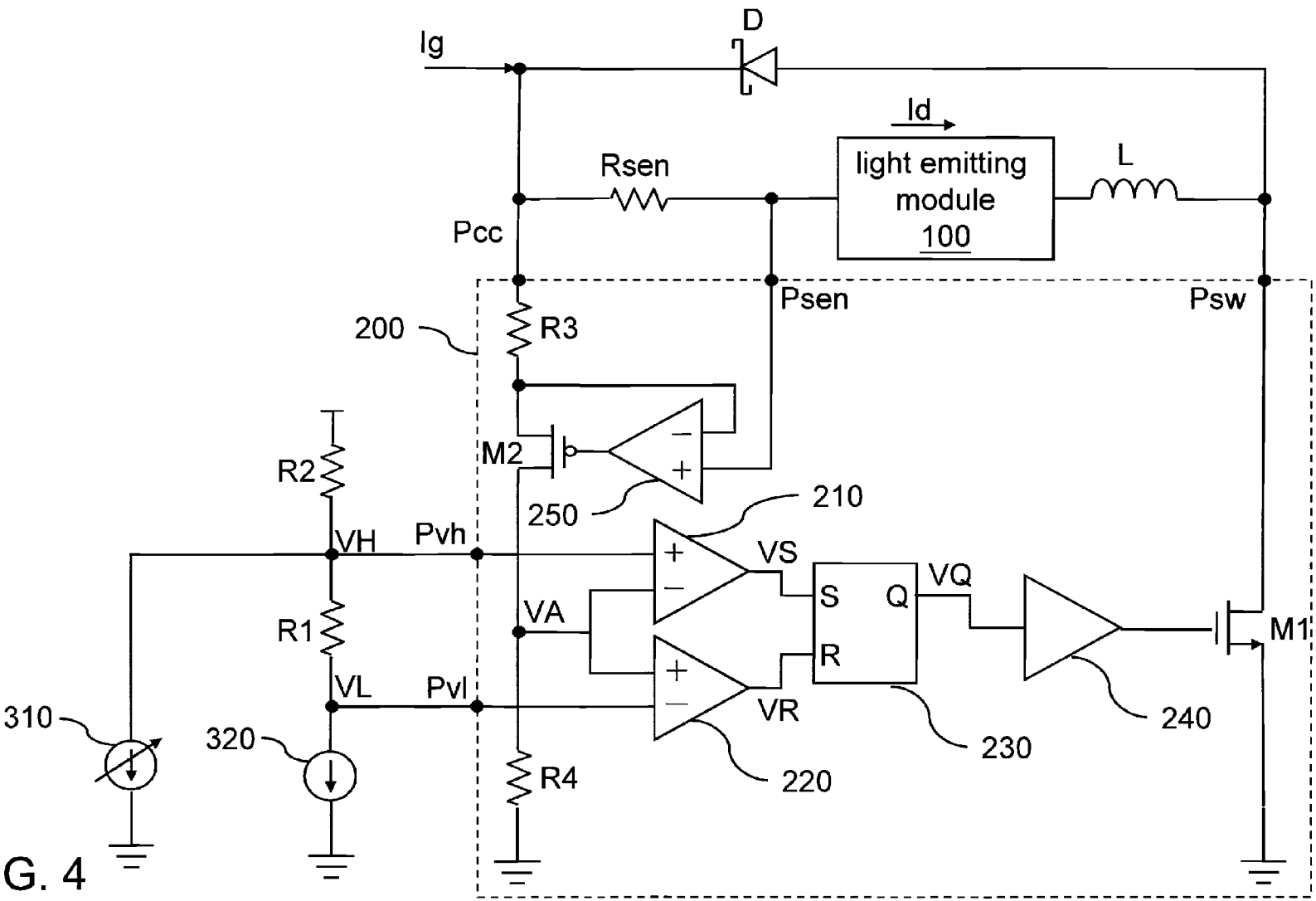
FIG. 4 is a schematic view of a fixed frequency dimming circuit for a light emitting module according to a fourth embodiment of the present invention.

Referring to FIG. 4, the fixed current source 320 is connected between the lower limit voltage VL and the ground. The controlled current source 310 is connected between the upper limit voltage end Pvh and the ground, so as to change the upper limit voltage VH. The first divider resistor R1 is connected between the upper limit voltage end Pvh and the lower limit voltage end Pvl. The second divider resistor R2 is connected between the fixed voltage source and the upper limit voltage end Pvh.

Here, the fixed current source 320 provides a fixed current to maintain reference voltages at hysteretic high and low levels of the hysteresis control circuit 200, that is, to maintain a constant voltage difference between the upper limit voltage end Pvh and the lower limit voltage end Pvl.

The controlled current source 310 provides a variable voltage (VH) to the upper limit voltage end Pvh, so as to adjust an output level (that is, the driving current Id of the light emitting module 100), thereby changing the light emitting brightness of the light emitting module 100.

When the output current of the controlled voltage source 310 is modulated, the upper limit voltage VH of the upper limit voltage end Pvh may be changed, and the lower limit voltage VL of the lower limit voltage end Pvl changes correspondingly based on the constant voltage difference.

Here, the hysteresis oscillation width of the hysteresis control circuit 200 linearly changes with the output level (that is, a level of the driving current Id), so as to keep a constant oscillation frequency of the hysteresis control circuit 200. Thus, a single component is used to protect against the electromagnetic interference (EMI). Moreover, as the oscillation frequency is kept constant, the fixed conversion efficiency can be maintained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixed frequency dimming method for a light emitting module, for controlling light emitting brightness of the light emitting module through a hysteresis control circuit, comprising:

connecting the light emitting module and an inductor component in series between a sensing end and a switching end of the hysteresis control circuit;

connecting an impedance component between a voltage input end and the sensing end of the hysteresis control circuit;

maintaining a voltage difference between an upper limit voltage and a lower limit voltage of a hysteresis width of the hysteresis control circuit at a fixed value; and comparing an input current with the upper limit voltage of the hysteresis width and the lower limit voltage of the hysteresis width, so as to control a current circulation time of the switching end, for limiting a driving current between the upper limit voltage of the hysteresis width and the lower limit voltage of the hysteresis width.

2. The fixed frequency dimming method according to claim 1, wherein a step of changing the driving current flowing through the light emitting module by changing the upper limit voltage or the lower limit voltage comprises: changing the upper limit voltage or the lower limit voltage through a controlled current source.

3. The fixed frequency dimming method according to claim 1, wherein a step of changing the driving current flowing through the light emitting module by changing the upper limit voltage or the lower limit voltage comprises: providing the upper limit voltage or the lower limit voltage through a controlled voltage source.

4. A fixed frequency dimming circuit for a light emitting module, for controlling light emitting brightness of the light emitting module, comprising:

a hysteresis control circuit, having a voltage input end, a sensing end, a switching end, an upper limit voltage end, and a lower limit voltage end, wherein a voltage difference between the upper limit voltage end and the lower limit voltage end is a fixed value, and a variable voltage is provided to the upper limit voltage end or the lower limit voltage end;

a fixed current source, connected to the upper limit voltage end;

a controlled current source, connected to the lower limit voltage end;

a first divider resistor, connected between the upper limit voltage end and the lower limit voltage end;

a second divider resistor, connected between the lower limit voltage end and a ground;

an inductor component, connected with the light emitting module in series between the sensing end and the switching end of the hysteresis control circuit; and an impedance component, connected between the voltage input end and the sensing end.

5. A fixed frequency dimming circuit for a light emitting module, for controlling light emitting brightness of the light emitting module, comprising:

a hysteresis control circuit, having a voltage input end, a sensing end, a switching end, an upper limit voltage end, and a lower limit voltage end, wherein a voltage difference between the upper limit voltage end and the lower limit voltage end is a fixed value, and a variable voltage is provided to the upper limit voltage end or the lower limit voltage end;

a fixed current source, connected to the lower limit voltage end;

a controlled current source, connected to the upper limit voltage end;

a first divider resistor, connected between the upper limit voltage end and the lower limit voltage end;

a second divider resistor, connected between the upper limit voltage end and a fixed voltage source;

an inductor component, connected with the light emitting module in series between the sensing end and the switching end of the hysteresis control circuit; and an impedance component, connected between the voltage input end and the sensing end.

6. A fixed frequency dimming circuit for a light emitting module, for controlling light emitting brightness of the light emitting module, comprising:

a hysteresis control circuit, having a voltage input end, a sensing end and a switching end, comprising:

a first comparator, wherein a negative input end of the first comparator is connected to the voltage input end; and a second comparator, wherein a positive input end of the second comparator is connected to the negative input end of the first comparator, a voltage difference between the positive input end of the first comparator and the negative input end of the second comparator is a fixed value, and a variable voltage is provided to the positive input end of the first comparator or the negative input end of the second comparator;

an inductor component, connected with the light emitting module in series between the sensing end and the switching end of the hysteresis control circuit; and an impedance component, connected between the voltage input end and the sensing end.

* * * * *